US009258644B2

(12) United States Patent
Maenpaa et al.

(10) Patent No.: US 9,258,644 B2
(45) Date of Patent: Feb. 9, 2016

(54) METHOD AND APPARATUS FOR MICROPHONE BEAMFORMING

(75) Inventors: Ossi E. Maenpaa, Salo (FR); Kimmo Makitalo, Tampere (FI); Mikko T. Tammi, Tampere (FI); Jussi Virolainen, Espoo (FI); Antti P. Kelloniemi, Espoo (FI)

(73) Assignee: Nokia Technologies Oy, Espoo (FI)

( * ) Notice: Subject to any disclaimer, the term of this patent is extended or adjusted under 35 U.S.C. 154(b) by 671 days.

(21) Appl. No.: 13/560,015

(22) Filed: Jul. 27, 2012

(65) Prior Publication Data

US 2014/0029761 A1 Jan. 30, 2014

(51) Int. Cl.

| | |
|---|---|
| ***H04R 3/00*** | (2006.01) |
| *H04R 1/02* | (2006.01) |
| *H04R 1/40* | (2006.01) |

(52) U.S. Cl.

CPC ..... *H04R 3/005* (2013.01); *H04R 1/028* (2013.01); *H04R 1/406* (2013.01); *H04R 2201/401* (2013.01); *H04R 2499/11* (2013.01)

(58) Field of Classification Search

CPC ..... H04R 3/005; H04R 1/028; H04R 1/406; H04R 2201/401; H04R 2499/11

See application file for complete search history.

(56) References Cited

U.S. PATENT DOCUMENTS

| | | | | |
|---|---|---|---|---|
| 5,335,011 | A | 8/1994 | Addeo et al. | 348/15 |
| 5,940,118 | A | 8/1999 | Van Schyndel | 348/14 |
| 6,005,610 | A | 12/1999 | Pingali | 348/169 |
| 6,593,956 | B1 | 7/2003 | Potts et al. | 348/14.09 |
| 6,826,284 | B1 | 11/2004 | Benesty et al. | 381/92 |
| 7,720,232 | B2 | 5/2010 | Oxford | 381/66 |
| 8,319,858 | B2 * | 11/2012 | Zhang | H04N 5/23212 348/231.4 |
| 2006/0133623 | A1 | 6/2006 | Amir et al. | 381/92 |
| 2008/0100719 | A1 | 5/2008 | Huang | 348/211.99 |
| 2009/0060222 | A1 | 3/2009 | Jeong et al. | 381/92 |
| 2009/0066798 | A1 * | 3/2009 | Oku et al. | 348/207.99 |
| 2010/0026780 | A1 | 2/2010 | Tico et al. | 348/14.02 |
| 2010/0110232 | A1 | 5/2010 | Zhang et al. | 348/240.3 |
| 2010/0245624 | A1 | 9/2010 | Beaucoup | 348/231.4 |
| 2011/0164141 | A1 | 7/2011 | Tico et al. | 348/207.99 |
| 2011/0317041 | A1 | 12/2011 | Zurek et al. | 348/240.99 |

(Continued)

FOREIGN PATENT DOCUMENTS

| | | |
|---|---|---|
| EP | 1 150 542 A1 | 1/2001 |
| EP | 1 571 875 A2 | 9/2005 |

(Continued)

OTHER PUBLICATIONS

R.L. Hsu, et al., "Face Detection in Color Images", IEEE Transactions on Pattern Analysis and Machine Intelligence, 24:696-706, 2002, 4 pgs.

(Continued)

*Primary Examiner* — Fan Tsang
*Assistant Examiner* — Eugene Zhao
(74) *Attorney, Agent, or Firm* — Harrington & Smith

(57) ABSTRACT

In accordance with an example embodiment of the present invention, an apparatus is disclosed. The apparatus includes a camera system and an optimization system. The optimization system is configured to communicate with the camera system. At least one microphone is connected to the optimization system. The optimization system is configured to adjust a beamform of the at least one microphone based, at least in part, on camera focus information of the camera system.

19 Claims, 9 Drawing Sheets

(56) References Cited

U.S. PATENT DOCUMENTS

| | | | | |
|---|---|---|---|---|
| 2012/0099732 | A1* | 4/2012 | Visser | 381/17 |
| 2013/0342731 | A1* | 12/2013 | Lee et al. | 348/231.4 |

FOREIGN PATENT DOCUMENTS

| | | | |
|---|---|---|---|
| JP | 2006-222618 | | 8/2006 |
| WO | WO-2011099167 | A1 | 8/2011 |

OTHER PUBLICATIONS

M.H. Yang et al., "Detecting Faces in Images: A Survey", IEEE Transactions on Pattern Analysis and Machine Intelligence, 24:34-58; 2002, 25 pgs.

A. Hadid et al., "A Hybrid Approach to Face Detection Under Unconstrained Environments", International Conference of Pattern Recognition, (ICPR 2006), 4 pgs.

U. Bub et al., "Knowing Who to Listen to in Speech Recognition: Visually Guided Beamforming", Interactive System Laboratories, 1995, 4 pgs.

M. Collobert et al., "Listen: A System for Locating and Tracking Individual Speakers", France Telecom, IEEE Transaction (1999), 6 pgs.

N. Strobel et al., "Joint Audio-Video Object Localization and Tracking" IEEE Signal Processing Magazine (2001), 6 pgs.

T.D. Abhayapala, et al., "Broadband beamforming using elementary shape invariant beampatterns", IEEE , May 1998, 1 pg.

A. Wang, et al., "Microphone array for hearing aid and speech enhancement applications", IEEE, Aug. 1996, 1 pg.

Jernej Mrovlje et al., "Distance measuring based on stereoscopic pictures", 9$^{th}$ International PhD Workshop on Systems and Control : Young Generation Viewpoint, Oct. 2008, 6 pgs.

"The Camera", Lytro, https://www.lytro.com/science_inside#; Jul. 27, 2012, 3 pgs.

* cited by examiner

METHOD AND APPARATUS FOR MICROPHONE BEAMFORMING

TECHNICAL FIELD

The invention relates to an electronic device and, more particularly, to microphone beamforming for an electronic device.

BACKGROUND

An electronic device typically comprises a variety of components and/or features that enable users to interact with the electronic device. Some considerations when providing these features in a portable electronic device may include, for example, compactness, suitability for mass manufacturing, durability, and ease of use. Increase of computing power of portable devices is turning them into versatile portable computers, which can be used for multiple different purposes. Therefore versatile components and/or features are needed in order to take full advantage of capabilities of mobile devices.

Electronic devices include many different features, such as microphone arrays where microphone beamforms can be adjusted mechanically or by calculating beamform from several microphone signals. Accordingly, as consumers demand increased functionality from the electronic device, there is a need to provide an improved device having increased capabilities, such as improved beamforming for audio capture, while maintaining robust and reliable product configurations.

SUMMARY

Various aspects of examples of the invention are set out in the claims.

According to a first aspect of the present invention. In accordance with one aspect of the invention, an apparatus is disclosed. The apparatus includes a camera system and an optimization system. The optimization system is configured to communicate with the camera system. At least one microphone is connected to the optimization system. The optimization system is configured to adjust a beamform of the at least one microphone based, at least in part, on camera focus information of the camera system.

According to a second aspect of the present invention. In accordance with another aspect of the invention, a method is disclosed. Focus location information is received. The focus location information corresponds to a focus location of a camera. Zoom setting information is received, wherein the zoom setting information corresponds to a zoom setting information of the camera. At least one microphone is controlled based, at least partially, on the focus location information and the zoom setting information.

According to a third aspect of the present invention. In accordance with another aspect of the invention, a computer program product comprising a non-transitory computer-readable medium bearing computer program code embodied therein for use with a computer is disclosed. The computer program code including: code for processing focus location information, wherein the focus location information corresponds to a focus location of a camera. Code for processing zoom setting information, wherein the zoom setting information corresponds to a zoom setting information of the camera. Code for controlling at least one microphone based, at least partially, on the focus location information and the zoom setting information.

BRIEF DESCRIPTION OF THE DRAWINGS

For a more complete understanding of example embodiments of the present invention, reference is now made to the following descriptions taken in connection with the accompanying drawings in which.

DETAILED DESCRIPTION OF THE DRAWINGS

An example embodiment of the present invention and its potential advantages are understood by referring to FIGS. 1 through 12 of the drawings.

Figure 2:
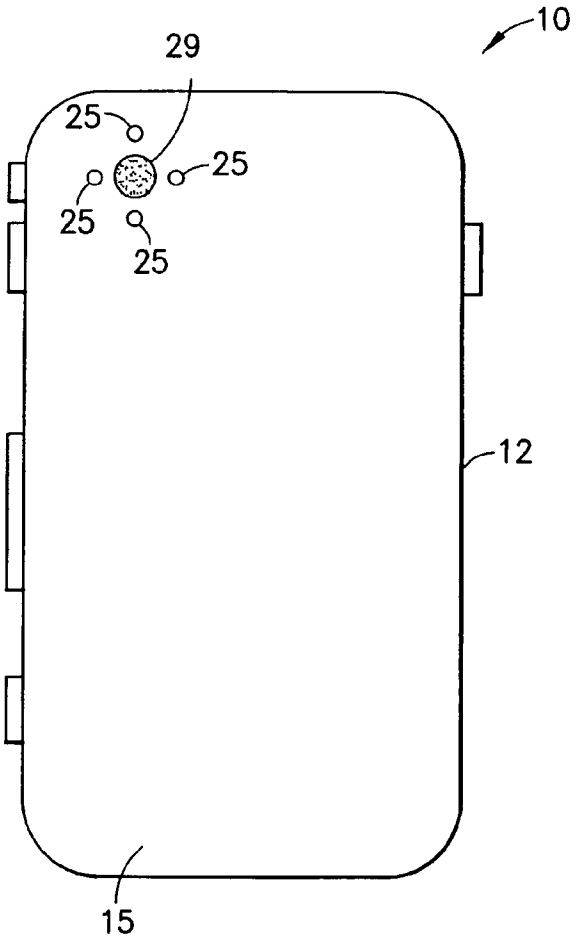
FIGS. 1 and 2 show front and rear views of an electronic device incorporating features of the invention.
Figure 1:
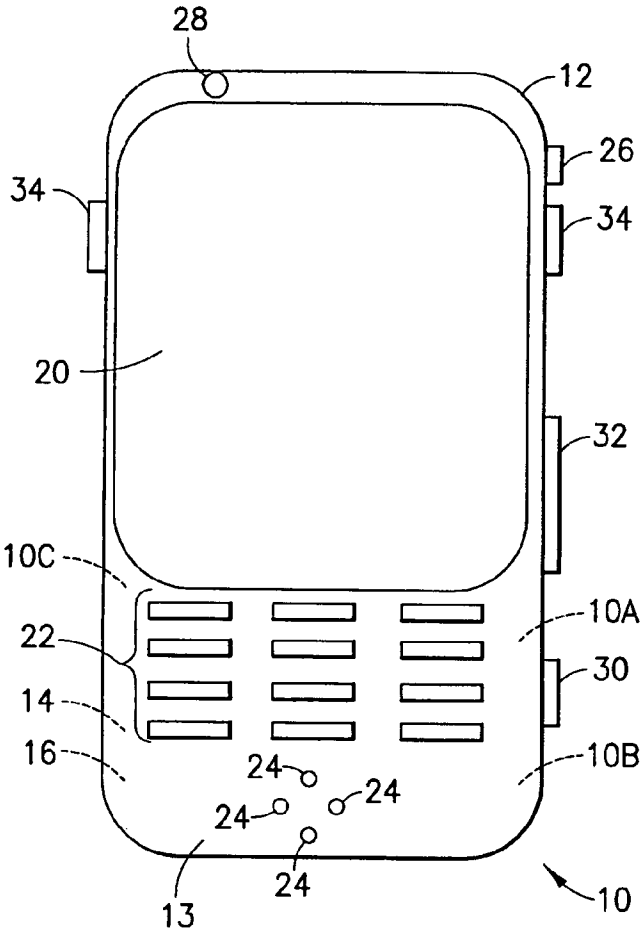

Referring to FIG. 1, there is shown a front view of an electronic device (or user equipment [UE]) 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

According to one example of the invention, the device 10 is a multi-function portable electronic device. However, in alternate embodiments, features of the various embodiments of the invention could be used in any suitable type of portable electronic device such as a mobile phone, a digital video camera, a portable camera, a gaming device, a music player, a portable computer, a personal digital assistant. Internet appliances permitting wireless Internet access and browsing, as well as portable units or terminals that incorporate combinations of such functions, for example. It should be noted that, according to some embodiments of the invention, the portable electronic device (including any of the non-limiting examples provided above) may have wireless communication capabilities. In addition, as is known in the art, the device 10 can include multiple features or applications such as a camera, a music player, a game player, or an Internet browser, for example. It should be noted that in alternate embodiments, the device 10 can have any suitable type of features as known in the art.

The device 10 generally comprises a housing 12, a graphical display interface 20, and a user interface 22 illustrated as a keypad but understood as also encompassing touch-screen technology at the graphical display interface 20 and voice-recognition technology (as well as general voice/sound reception, such as, during a telephone call, for example) received at forward facing microphones 24. A power actuator 26 controls the device being turned on and off by the user. The exemplary UE 10 may have a forward facing camera 28 (for example for video calls) and/or a rearward facing camera 29 (for example for capturing images and video for local storage, see FIG. 2), and rearward facing microphones 25. The cameras 28, 29 could comprise a still image digital camera and/or a video camera, or any other suitable type of image taking device. The cameras 28, 29 are generally controlled by a shutter actuator 30 and optionally by a zoom actuator 32. While various exemplary embodiments have been described above in connection with physical buttons or switches on the device 10 (such as the shutter actuator and the zoom actuator, for example), one skilled in the art will appreciate that embodiments of the invention are not necessarily so limited and that various embodiments may comprise a graphical user interface, or virtual button, on the touch screen instead of the physical buttons or switches.

While various exemplary embodiments of the invention have been described above in connection with the graphical display interface 20 and the user interface 22, one skilled in the art will appreciate that exemplary embodiments of the invention are not necessarily so limited and that some embodiments may comprise only the display interface 20 (without the user interface 22) wherein the display 20 forms a touch screen user input section.

The UE 10 includes electronic circuitry such as a controller, which may be, for example, a computer or a data processor (DP) 10A, a computer-readable memory medium embodied as a memory (MEM) 10B that stores a program of computer instructions (PROG) 10C, and a suitable radio frequency (RF) transmitter 14 and receiver configured for bidirectional wireless communications with a base station, for example, via one or more antennas.

The PROGs 10C is assumed to include program instructions that, when executed by the associated DP 10A, enable the device to operate in accordance with the exemplary embodiments of this invention, as will be discussed below in greater detail.

That is, the exemplary embodiments of this invention may be implemented at least in part by computer software executable by the DP 10A of the UE 10, or by hardware, or by a combination of software and hardware (and firmware).

The computer readable MEM 10B may be of any type suitable to the local technical environment and may be implemented using any suitable data storage technology, such as semiconductor based memory devices, flash memory, magnetic memory devices and systems, optical memory devices and systems, fixed memory and removable memory. The DP 10A may be of any type suitable to the local technical environment, and may include one or more of general purpose computers, special purpose computers, microprocessors, digital signal processors (DSPs) and processors based on a multicore processor architecture, as non-limiting examples.

Figure 3:
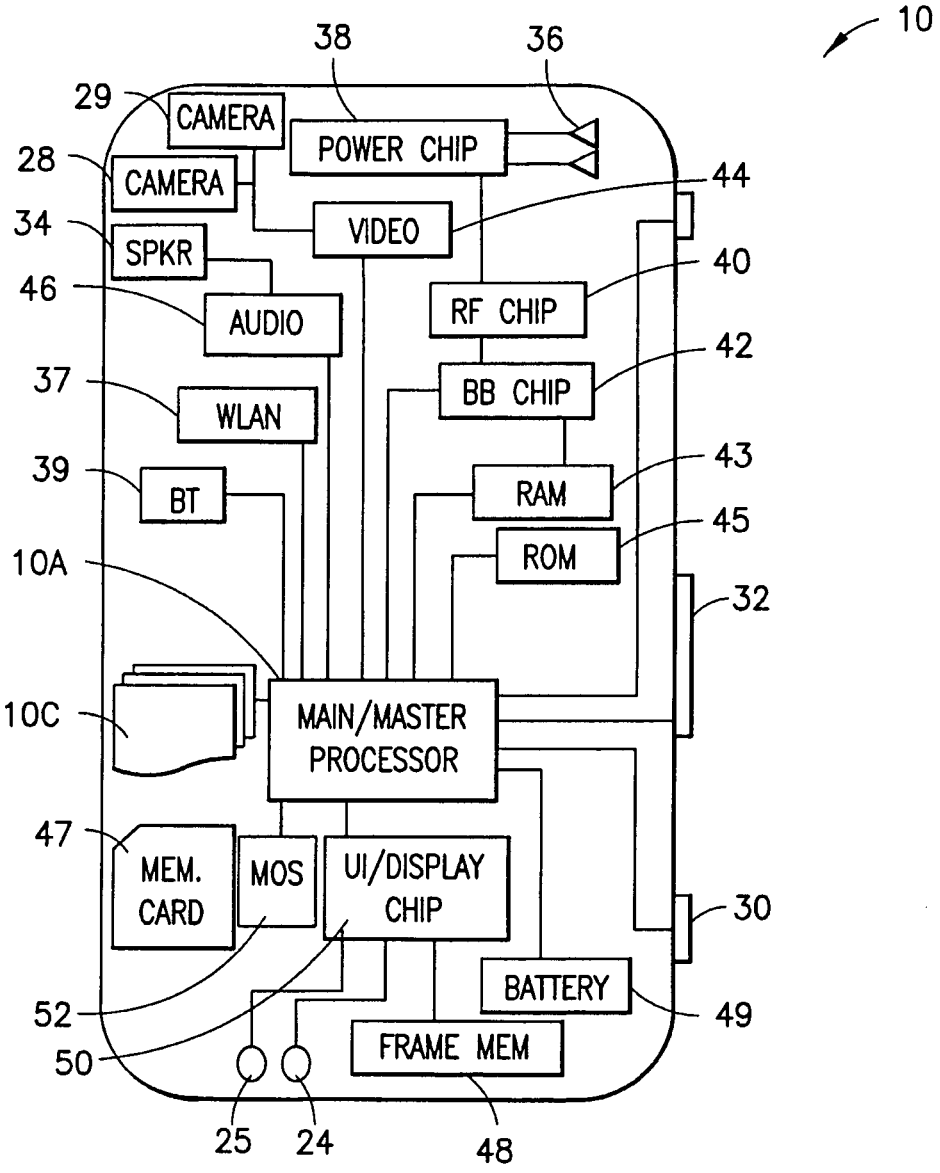
FIG. 3 is a more particularized block diagram of the device shown in FIG. 1.

Referring now also to the sectional view of FIG. 3, there are seen multiple transmit/receive antennas that are typically used for cellular communication. The antennas 36 may be multi-band for use with other radios in the UE. The operable ground plane for the antennas 36 is shown by shading as spanning the entire space enclosed by the UE housing though in some embodiments the ground plane may be limited to a smaller area, such as disposed on a printed wiring board on which the power chip 38 is formed. The power chip 38 controls power amplification on the channels being transmitted and/or across the antennas that transmit simultaneously where spatial diversity is used, and amplifies the received signals. The power chip 38 outputs the amplified received signal to the radio-frequency (RF) chip 40 which demodulates and downconverts the signal for baseband processing. The baseband (BB) chip 42 detects the signal which is then converted to a bit-stream and finally decoded. Similar processing occurs in reverse for signals generated in the apparatus 10 and transmitted from it.

Signals to and from the cameras 28, 29 pass through an image/video processor 44 which encodes and decodes the various image frames. A separate audio processor 46 may also be present controlling signals to and from the speakers 34 and the microphones 24, 25. The graphical display interface 20 is refreshed from a frame memory 48 as controlled by a user interface chip 50 which may process signals to and from the display interface 20 and/or additionally process user inputs from the keypad 22 and elsewhere.

Certain embodiments of the UE 10 may also include one or more secondary radios such as a wireless local area network radio WLAN 37 and a Bluetooth® radio 39, which may incorporate an antenna on-chip or be coupled to an off-chip antenna. Throughout the apparatus are various memories such as random access memory RAM 43, read only memory ROM 45, and in some embodiments removable memory such as the illustrated memory card 47. The various programs 100 are stored in one or more of these memories. All of these components within the UE 10 are normally powered by a portable power supply such as a battery 49.

The aforesaid processors 38, 40, 42, 44, 46, 50, if embodied as separate entities in the UE 10, may operate in a slave relationship to the main processor 10A, which may then be in a master relationship to them. Embodiments of this invention may be disposed across various chips and memories as shown or disposed within another processor that combines some of the functions described above for FIG. 3. Any or all of these various processors of FIG. 3 access one or more of the various memories, which may be on-chip with the processor or separate therefrom.

Note that the various chips (e.g., 38, 40, 42, etc.) that were described above may be combined into a fewer number than described and, in a most compact case, may all be embodied physically within a single chip.

The housing 12 may include a front housing section (or device cover) 13 and a rear housing section (or base section) 15. However, in alternate embodiments, the housing may comprise any suitable number of housing sections.

The electronic device 10 further comprises an optimization system 52. The optimization system 52 is connected to the cameras 28, 29 and the microphones 24, and provides for video camera microphone automatic beamforming based on camera focus distance information.

It should be noted that the optimization system 52, may be referred to as a microphone optimization system, an audio signal optimization system, or a recording optimization system.

According to various exemplary embodiments of the invention, the microphone optimization system 52 provides for microphone beamforming for the array of microphones 24 based on the camera focus distance information of the camera 28, and the microphone optimization system 52 provides for microphone beamforming for the array of microphones 25 based on the camera focus distance information of the camera 29. However, in alternate embodiments, any suitable location Or orientation for the microphones 24, 25 may be provided. The array of microphones 24 are configured to capture sound from a source generally viewable in images taken from, or generally in the direction of, the camera 28. The array of microphones 25 are configured to capture sound from a source generally viewable in images taken from, or generally in the direction of, the camera 29. The microphones 24, 25 may be configured for microphone array beam steering in two dimensions (2D) or in three dimensions (3D). In the example shown in FIGS. 1, 2, the array of microphones 24, 25 each comprises four microphones. However, in alternate embodiments, more or less microphones may be provided.

According to various exemplary embodiments of the invention, the microphone optimization system 52 optimizes a microphone beam by using camera focus information and zoom parameter information wherein the distance between the sound source and camera is estimated and accordingly the beam angle is optimized.

The microphone optimization system 52 may provide for tracking of the sound source and controlling of the directional sensitivity of the microphone array for directional audio capture to improve the quality of voice and/or video calls in various types of noise environments.

The microphone optimization system 52 is configured to use one or more parameters corresponding to the camera (or camera module/system) in order to assist the audio capturing process. This may be performed by determining the camera focus and zoom information and using the camera focus and zoom information together to detect a distance between the sound source and the video camera, and forming the beam of the microphone array towards the reference point. According to various exemplary embodiments of the invention, zoom and focus information can be used in several different ways to adjust microphone beam in different usage profiles.

The microphone optimization system 52 detects and tracks the sound source in the video frames captured by the camera. The fixed positions of the camera and microphones within the device allows for a known orientation of the camera relative to the orientation of the microphone array (or beam orientation). It should be noted that references to microphone beam orientation or beam orientation may also refer to a sound source direction with respect to a microphone array. The microphone optimization system 52 may be configured for selective enhancement of the audio capturing sensitivity along the specific spatial direction towards the sound source. For example, the sensitivity of the microphone array 24, 25 may be adjusted towards the direction of the sound source. It is therefore possible to reject unwanted sounds, which enhances the quality of audio that is recorded or captured. The unwanted sounds may come from the sides of the device, or any other direction (such as any direction other than the direction towards the sound source, for example), and could be considered as background noise which may be cancelled or significantly reduced.

In enclosed environments where reflections might be evident, as well as the direct sound path, examples of the invention improve the direct sound path by reducing and/or eliminating the reflections from surrounding objects (as the acoustic room reflections of the desired source are not aligned with the direction-of-arrival [DOA] of the direct sound path). The attenuation of room reflections can also be beneficial, since reverberation makes speech more difficult to understand. Embodiments of the invention provide for audio enhancement during silent portions of speech partials by tracking the position of the sound source by accordingly directing the beam of the microphone array towards the sound source.

Figure 4:
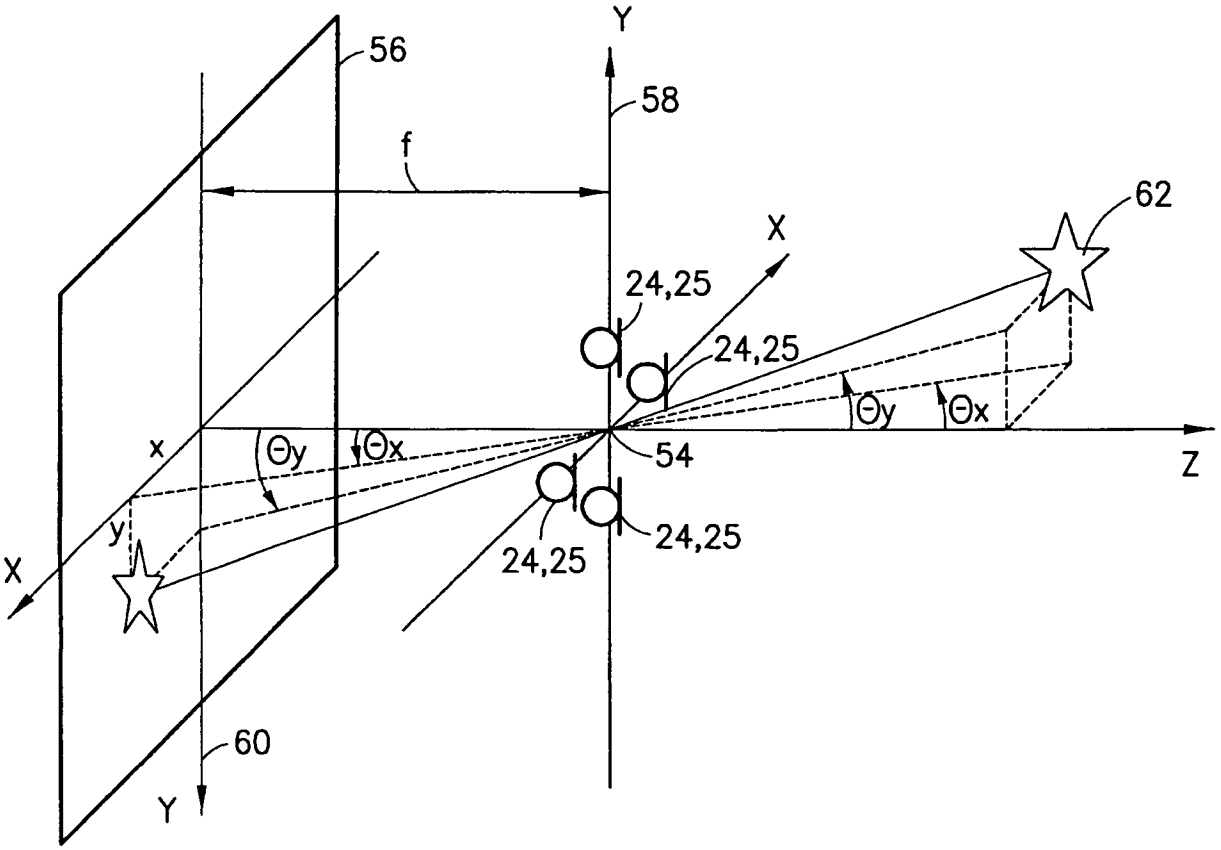
FIG. 4 is a diagram of a portion of a system used in the electronic device shown in FIG. 1 relative to a source and coordinate system.

Referring now also to FIG. 4, a diagram illustrating one example of how the direction to the (tracking sound source) position may be determined is shown. The direction (relative to the optical center 54 of the camera 28 [or 29]) of the sound source 62 is defined by two angles $\theta_x$, $\theta_y$. In the embodiment shown, the image sensor plane where the image is projected is illustrated at 56, the 3D coordinate system with the origin at the camera optical center is illustrated at 58, and the 2D image coordinate system is illustrated at 60.

The sound source direction may be determined with respect to the microphone array 24 [or 25] (such as, a 3D direction of the sound source, for example), based on the sound source position in the video frame, and based on knowledge about the camera focal length. Generally the two angles (along horizontal and vertical directions) that define the 3D direction can be determined as follows:

$$\theta_x = a\tan(x/f),\ \theta_y = a\tan(y/f)$$

where f denotes the camera focal length, and x, y is the position of the sound source with respect to the frame image coordinates (see FIG. 4).

Figure 6:
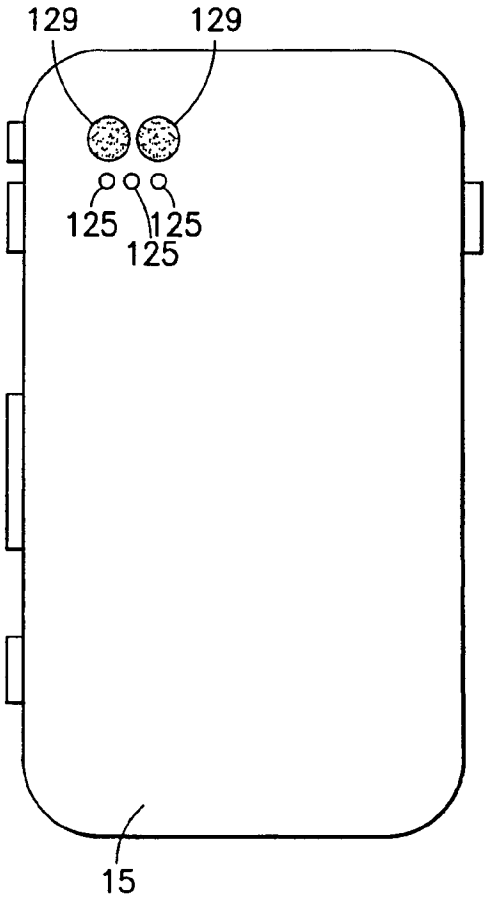
FIGS. 5 and 6 show front and rear views of another electronic device incorporating features of the invention.
Figure 5:
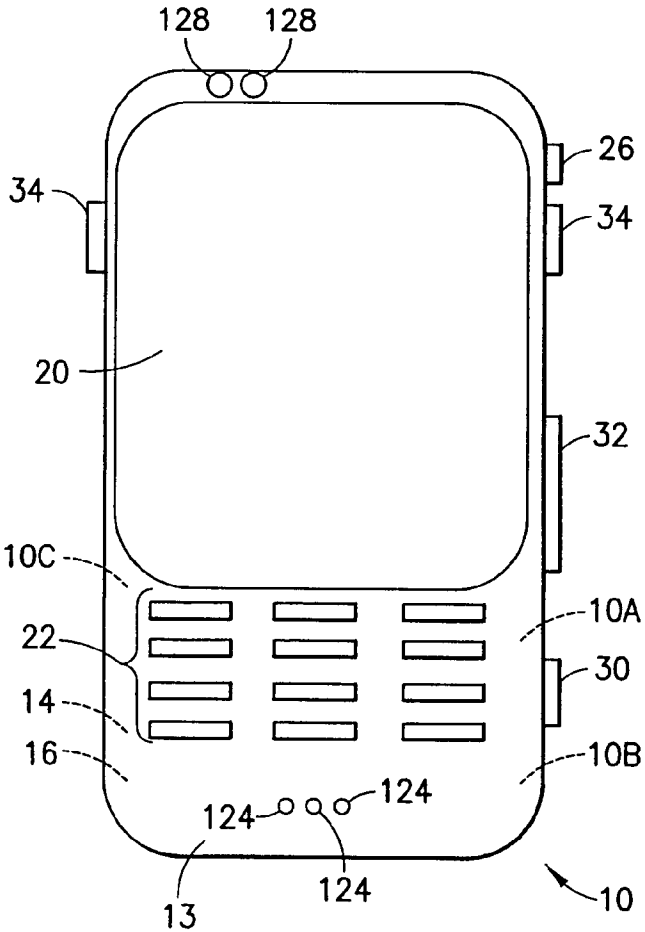

According to some embodiments of the invention, the microphone optimization system 52 may be provided for use with configurations having one camera and four microphones (as described above). In alternate embodiments, other camera/microphone configurations may be provided. For example, the microphone optimization system 52 may instead be connected to two cameras 128, 129 and three microphones 124, 125 (as shown in FIGS. 5, 6), and provide for video camera microphone automatic beamforming based on camera focus distance information. However, it should be noted that in other alternate embodiments, any suitable number of cameras and microphones may be provided. The array of microphones 124 are configured to capture sound from a source generally viewable in images taken from, or generally in the direction of, the cameras 128. The array of microphones 125 are configured to capture sound from a source generally viewable in images taken from, or generally in the direction of, the cameras 129. Generally, focus distance can be detected between about 0.1-10 meters. This information can be delivered to audio DSP to adjust the microphone beamform.

Figure 6B:
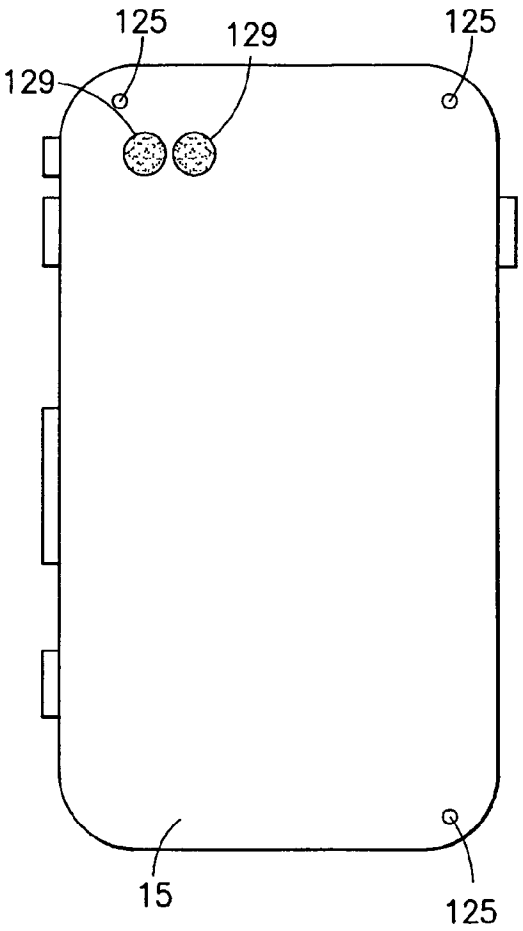
FIGS. 6A and 6B show front and rear views of another electronic device incorporating features of the invention.
Figure 6A:
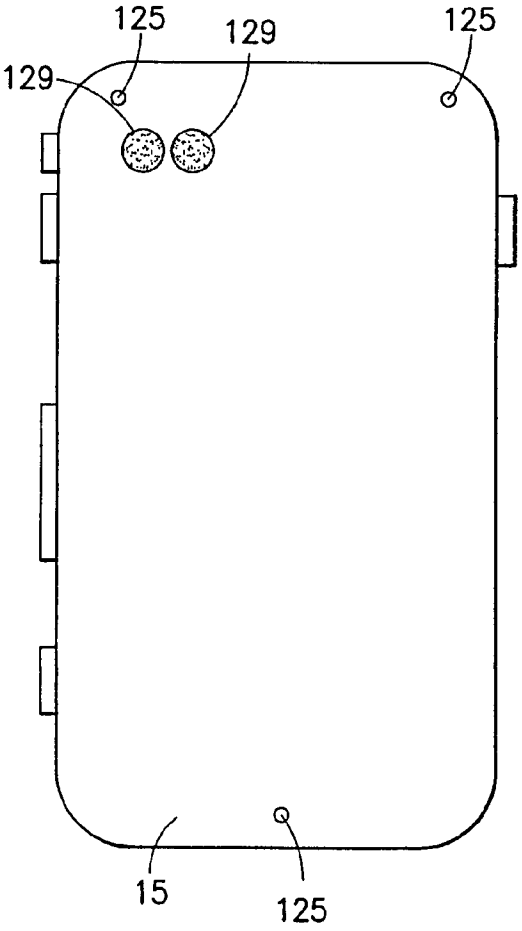

It should be noted that although FIGS. 5 and 6 illustrate the three microphones 124, 125 directly below the two cameras 128, 129, any suitable orientation or configuration may be provided. For example, the microphones may be spaced further from the cameras. In some embodiments, the microphones may be located in the upper left corner, upper right corner, and a lower center position (as shown in FIG. 6A), in some other embodiments, the microphones may be located in the upper left corner, upper right corner, and a lower corner position (as shown in FIG. 6B). This illustrates that any suitable orientation for the microphones and cameras could be provided. Additionally, while various exemplary embodiments of the invention have been described in connection with adjusting to the audio focus angle relative to an image plane, one skilled in the art will appreciate that various exemplary embodiments of the invention are not necessarily so limited and some examples of the invention may provide for adjusting the audio focus angle on X and Y coordinates. For example, with various microphone and camera orientations, an 'elevation' of the sound source could be accounted for.

Figure 7:
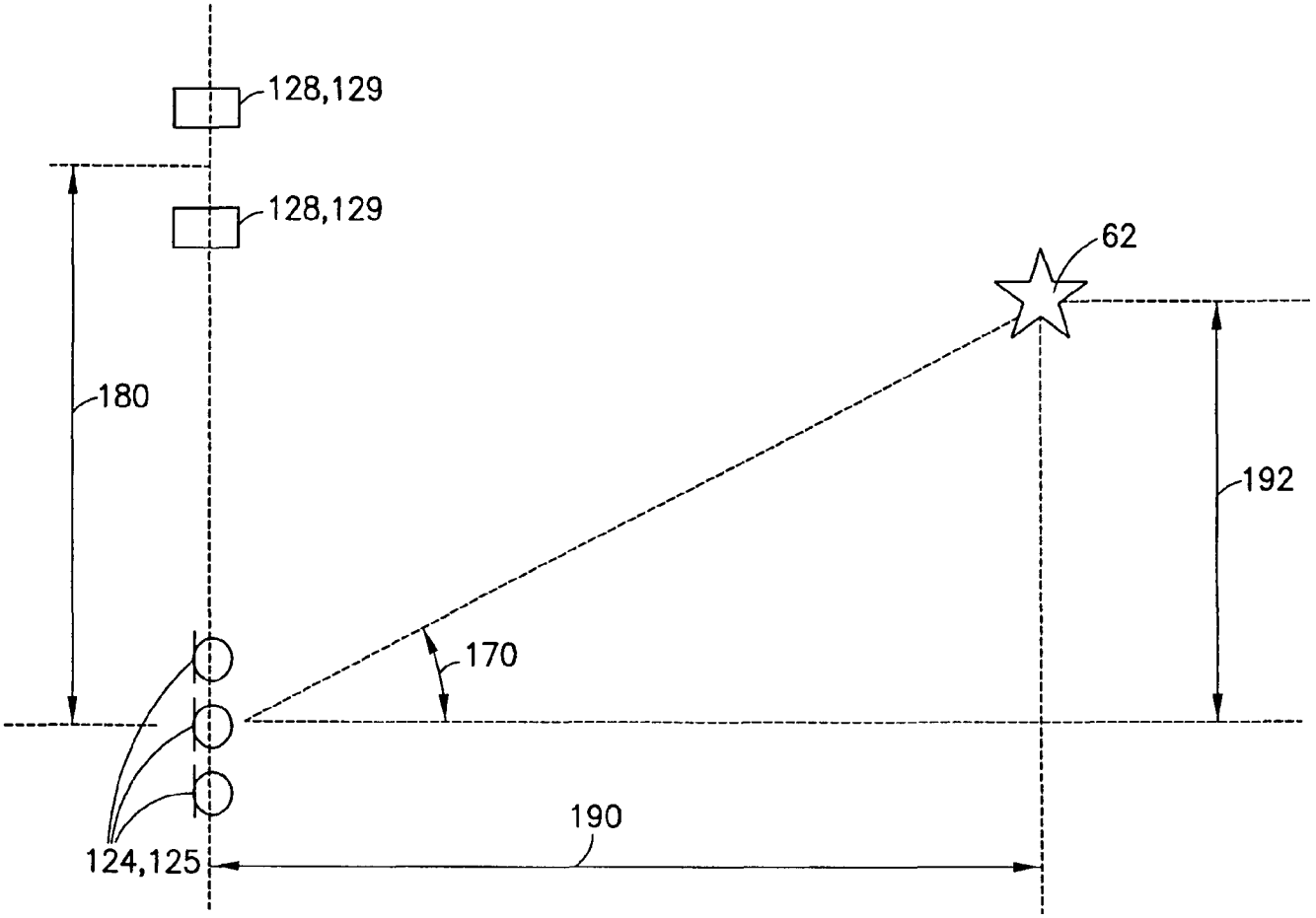
FIG. 7 is a diagram of a portion of a system used in the electronic device shown in FIGS. 5, 6, 6A, 6B relative to a source.

Referring now also to FIG. 7, the microphone optimization system 52 provides for audio quality improvement by using two cameras 128, 129 to estimate the beam orientation 170 relative the sound source 62. If the microphone array is located far away from the camera view angle (effectively camera module itself) as shown in FIG. 5, the distance between the sound source and center of the microphone array may be difficult to calculate. For example, for a larger distance 180, the depth 190 information may be provided to estimate the beam orientation 170. The estimation of the microphone beam direction 170 relevant to the sound source 62 may be provided by using the two cameras 128 (or 129) to estimate the depth 190 (which may further be based, at least in part, on the distance 180 between the cameras and the microphone array). Additionally, it should be noted that an elevation (or azimuth) 192 of the sound source 62 may be estimated with the cameras 128 (or 129). Additionally, in some embodiments of the invention, distance information may be also obtained with a single 3D camera technology providing depth map for the image. It should further be understood that any other suitable method of detecting distance may be provided, for example, according to some examples of the invention, various methods using a proximity sensor to detect distance of the visual object (and set camera focus accordingly) may be provided.

Figure 8:
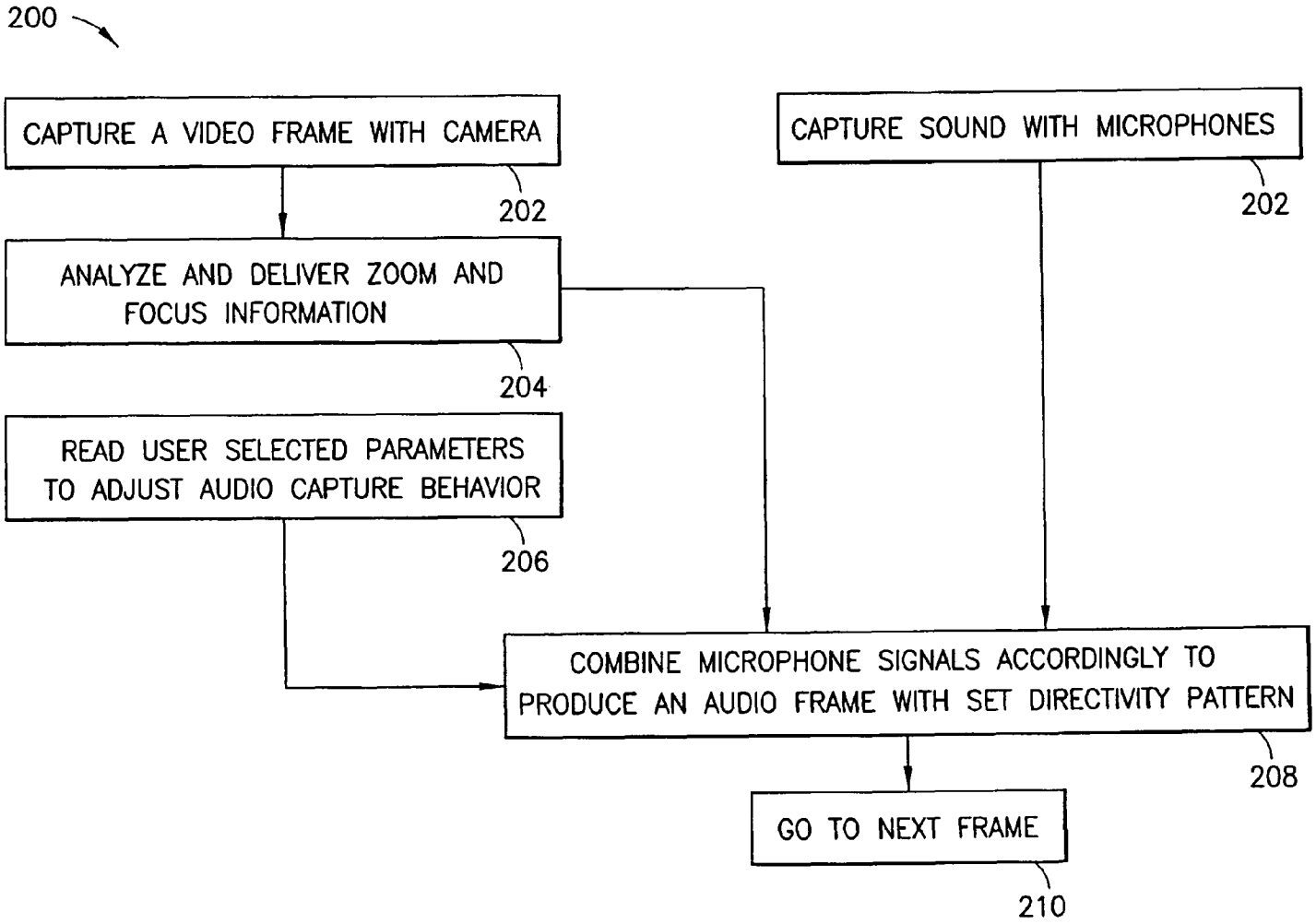
FIG. 8 is a block diagram of an exemplary method of the device shown in FIGS. 1, 2, 5, 6, 6A, 6B.

Referring now also to FIG. 8, an exemplary algorithm 200 of the microphone optimization system 52 is illustrated. The algorithm may be provided for implementing the tracking of the sound source and controlling the sensitivity of directional microphone beam of the microphone array 24, 25, 124, 125 (for the desired audio signal to be transmitted). The algorithm may include the following: capture a video frame with the camera(s), and capture sound with the microphones (at block 202). Analyze and deliver zoom and focus information from the camera (at block 204). Read user selected parameters to adjust audio capture behavior (at block 206). Combine microphone signals accordingly to produce an audio frame with set directivity pattern (at block 208). Go to next frame (at block 210). It should further be noted that, according to some embodiments of the invention, the algorithm 200 may further comprise a 'block' which provides for using the history knowledge of the audio capture directivity pattern as another input in determining the correct directivity pattern for the current frame. It should be noted that the illustration of a particular order of the blocks does not necessarily imply that there is a required or preferred order for the blocks and the order and arrangement of the blocks may be varied. Furthermore it may be possible for some blocks to be omitted. It should further be noted that the algorithm may be provided as an infinite loop. However, in alternate embodiments, the algorithm could be a start/stop algorithm by specific user interface (UI) commands, for example. However, any suitable algorithm may be provided.

According to various exemplary embodiments of the invention, camera focus and zoom information are used together to detect distance between sound source and video camera. Zoom and focus information can be used in several different ways to adjust microphone beam in different usage profiles. For example if distance is long, a narrow microphone beamform can be used regardless camera zoom position. In another example, a narrow beamform can be used to decrease noise level when the primary sound source occupies large part of the picture area (large zoom or sound source is near). In another example, beamform can be directed towards the focus area, also if it is not in the center of the picture area.

Figure 11:
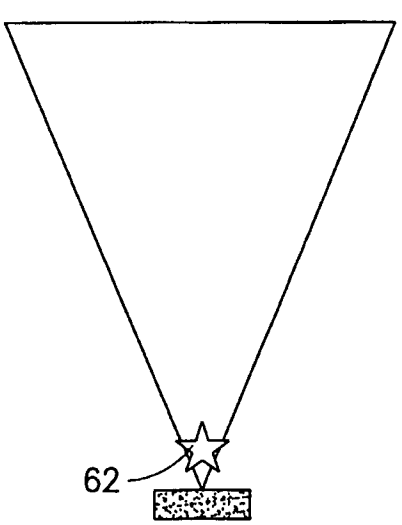
FIGS. 9-11 show a diagram illustrating various microphone beam widths for the device shown in FIGS. 1, 2, 5, 6, 6A, 6B.
Figure 10:
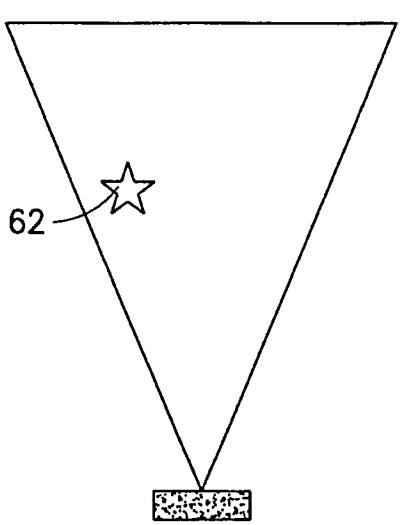
Figure 9:
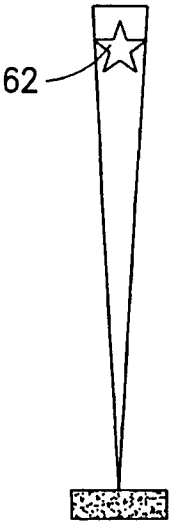

Referring now also to FIGS. 9-11, there are shown examples wherein, depending on the user's choice, the microphone beam width can be adjusted according to a combination of focus location and zoom setting of the camera(s) 28 (or 29, 128, 129). For example, FIG. 9 illustrates the zoom setting at 'narrow', and the focus location at 'far'. FIG. 10 illustrates the zoom setting at 'wide', and the focus location at 'mid'. FIG. 11 illustrates the zoom setting at 'wide', and the focus location at 'near'. Different functionalities may be selectable for the user as audio capture profiles, for example through the touch screen 20 and/or the user interface 22. The user of the device 10 may also select a range for the automatic beam width adjustment (for example 'narrow'/'mid'/'wide'), or the options may be defined based on functionality (for example zoom/maximal ambient noise reduction/automatic/manual). According to various exemplary embodiments of the invention, the camera focus and zoom information is delivered to the audio DSP and the microphone beamform is adjusted accordingly.

According to various exemplary embodiments where there are several cameras (or at least more than one camera) or otherwise a camera that can create stereo image, this provides for even more accurate distance information to be available for processing. According to some embodiments of the invention, the distance information of a visual object can be derived also from the 3D picture directly and then the microphone beam parameters can be defined accordingly. Some example embodiments of the invention may provide for distance detection from a 'stereo picture' by any suitable stereoscopy technique used for recording and representing stereoscopic (3D) images which create an illusion of depth using two pictures taken at slightly different positions and/or slightly different times. According to some example embodiments of the invention, an algorithm could be provided which is configured to extract three-dimensional (3D) data based on slight (or large) movement of the camera between captured frames. For example, and as mentioned above, the stereoscopic images may be provided by using 'two-lens' stereo cameras or systems with two 'single-lens' cameras joined together, or any suitable lens/camera configuration configured for stereoscopic images.

Focus information can also include information other than distance parameters, such as a focus spot position on an image plane, face detection, or motion detection. These parameters can be used to select the best beamwidth in each case, and to adjust direction of audio capture. According to some embodiments of the invention, the beam may even dynamically follow an object in the image.

According to various exemplary embodiments of the invention, a distance controlled audio capture mode of the device 10 may be provided as follows: the user of the device sets the focus to a certain object (or sound source). When user zooms in or out (with autofocus on) the microphone beam width is not changed, since the physical distance between camera and target remains the same.

The audio capture beamwidth may depend on the zoom and focus spot position in a predefined manner (such as with a table lookup, or other similar technique, for example), or the beamform may be selected based on fuzzy logic (neural network or similar, for example), taking into account the current and previous beamform setting and features of the surrounding sound field, such as the proportion between direct and reverberant sound, or the proportion between sound captured from the picture area and from other directions.

According to various exemplary embodiments of the invention, various post-processing operations may be provided. Similar to light field camera techniques (also known as plenoptic camera) which enable refocusing after the picture has been taken (such as technologies developed by Lytro, Inc., of Mountain View, Calif., for example), various exemplary embodiments of the invention may provide for the post-processing of the microphone beams (after the audio capture) as all of the captured microphone signals are stored in their own audio tracks. In combination with light field video camera, microphone beam adjustment could also be linked to the user selectable focus in the post-processing stage. According to some exemplary embodiments of the invention, the sound of objects soon entering the picture area could be enhanced in the post-processing stage by aiming the microphone array directivity outside of the picture area, increasing the immersion effect.

Various non-limiting example use cases where significant advantages are provided by the microphone optimization system 52 by providing automatic microphone beam forming in audio recording level are described below.

'Theater/concert' environment: With suitable setting, the automatic microphone beamform captures the stage sound in a steady manner, even if user changes the zoom level. Surrounding noise is effectively attenuated. If beamform would be constant, it would typically be too wide and noise level would be high. If beamform would only be adjusted based on zoom level, the signal-to-noise level would change (in a generally annoying fashion to the user).

'Interview of one person' environment: Automatic audio beamform will focus on the interviewed person, following the camera focus information, and decrease the captured noise level.

'Party' or 'traffic' environment: In a low signal-to-noise situation, automatically focusing the picture and audio to same object improves intelligibility of the signal significantly, simulating the natural cocktail party-effect of human auditory system.

'Sports event' environment: Quickly changing situations and constantly changing zoom selections challenge traditional audio capture solutions. When zoom and focus information from camera is combined, correct beamform may be selected automatically much more easier than if the beam form would be constant or if it would change with zoom selection.

While various exemplary embodiments of the invention have described the microphone optimization system 52 in connection with the zoom and focus information, some other example embodiments may further utilize face detection, facial recognition, and/or face tracking methods in combination with the zoom and/or focus information.

Technical effects of any one or more of the exemplary embodiments provide for microphone beamforming based on parameters taken from the camera module (or camera system) which provide significant improvements in audio capture over when compared to conventional configurations (such as video cameras and mobile phones equipped with video camera option have adjustable or automatically adjusting polar patterns in microphone to select suitable beamform according sound source distance and background noise conditions, for example). In many of the conventional devices, typically microphone polar pattern needs to be adjusted manually, or beamform is adjusted according to camera zoom information. In the latter case the audio recording level and ratio between direct sound and ambient noise pumps up & down if distance to sound source is constant but zoom is used to pic up narrower picture (=audio zoom functionality).

Technical effects of any one or more of the exemplary embodiments provide for Automatic beamforming without requiring a complex implementation. Some conventional configurations have used video detection and tracking of human faces, control the directional sensitivity of the microphone array for directional audio capture, or use stereo imaging for capturing depth information to the objects. Additionally, in some conventional configurations a user can select the beamform manually, or the device can adjust the beamwidth according to camera zoom information or distance to audio source can be detected with other methods. Furthermore, in some conventional configurations, means to create a controllable beamform is introduced. However, various exemplary examples of the invention provide an improved configuration which links the audio capture beamforming and the image focus information, whereby the camera focus is adjusted automatically and the focus information is available and used for adjusting the audio capture.

Various exemplary embodiments of the invention include hardware and software integration for camera focus/zoom and software support between the audio channel and the camera module, wherein the directionality of a suitable microphone module or a microphone array can be shaped.

Figure 12:
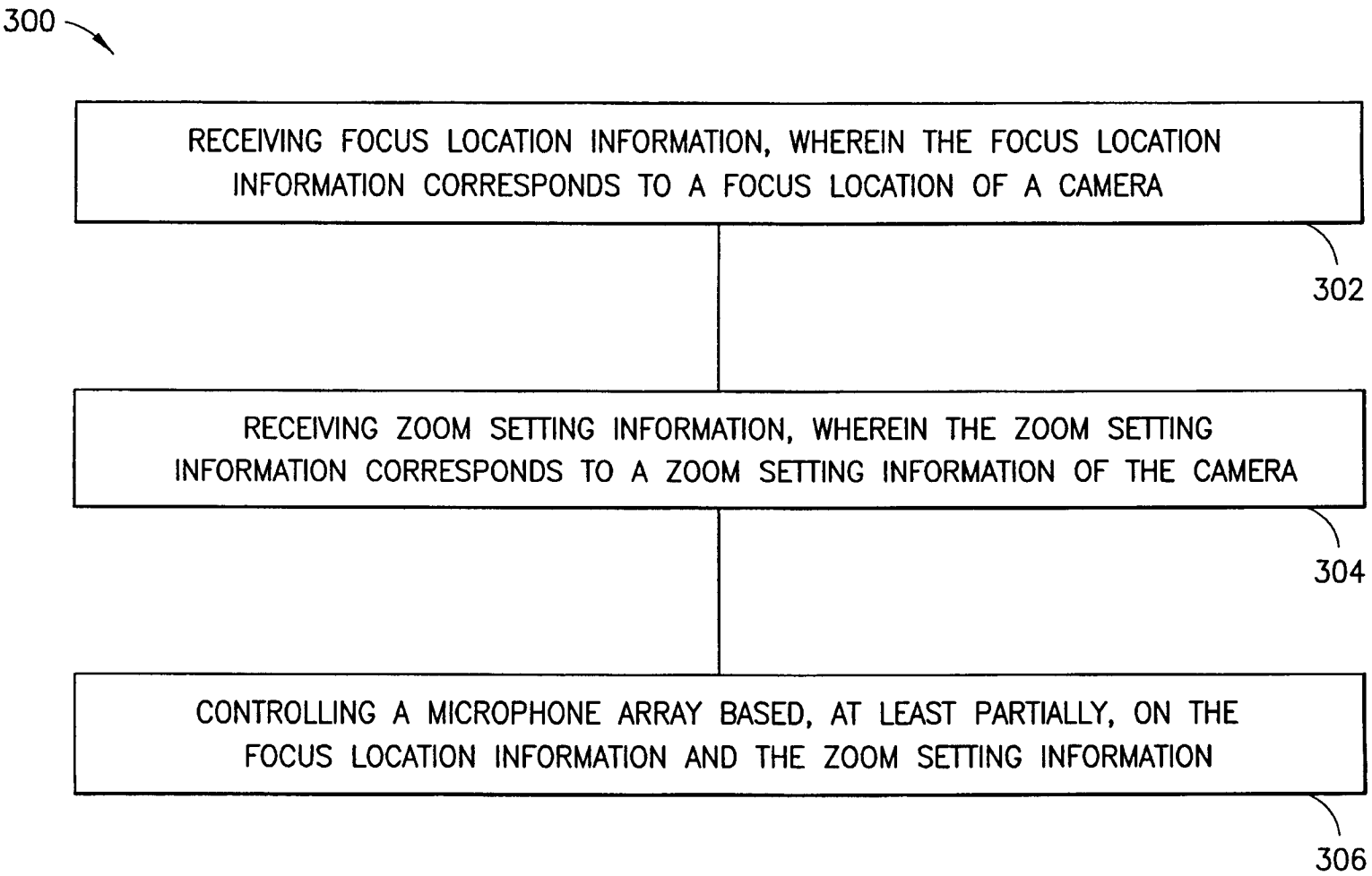
FIG. 12 is a block diagram of another exemplary method of the device shown in FIGS. 1, 2, 5, 6, 6A, 6B.

FIG. 12 illustrates a method 300. The method 300 includes receiving focus location information, wherein the focus location information corresponds to a focus location of a camera (at block 302). Receiving zoom setting information, wherein the zoom setting information corresponds to a zoom setting information of the camera (at block 304). Controlling a microphone array based, at least partially, on the focus location information and the zoom setting information (at block 306). It should be noted that the illustration of a particular order of the blocks does not necessarily imply that there is a required or preferred order for the blocks and the order and arrangement of the blocks may be varied. Furthermore it may be possible for some blocks to be omitted.

Without in any way limiting the scope, interpretation, or application of the claims appearing below, a technical effect of one or more of the example embodiments disclosed herein is a method for microphone beam forming, based on camera focus and zoom information in video cameras and mobile phones. Another technical effect of one or more of the example embodiments disclosed herein is to select the input parameters, i.e. focus direction and beam width, in a new way. Another technical effect of one or more of the example embodiments disclosed herein is to use the image focus information for microphone beamforming. Another technical effect of one or more of the example embodiments disclosed herein is to use camera focus (=distance) information to automatically adjust the microphone beamform. Another technical effect of one or more of the example embodiments disclosed herein is to use camera focus position data to adjust beamform of separate acoustical microphone solution. Another technical effect of one or more of the example embodiments disclosed herein is providing improvements in recorded audio quality with less noise and distortion through automatic and intelligent microphone beamforming. Another technical effect of one or more of the example embodiments disclosed herein is allowing automatic microphone beamforming without 'pumping' effect in audio recording level. Another technical effect of one or more of the example embodiments disclosed herein is focusing the audio and video synchronously, which decreases the distraction level and increases intelligibility. Another technical effect of one or more of the example embodiments disclosed herein is that, compared to non-automatic adjustment methods of microphone beam width, various exemplary embodiments of the algorithm may include either realtime computation or saving additional data to enable post processing. Another technical effect of one or more of the example embodiments disclosed herein is straightforward and user friendly implementation, automatic and adaptable beamforming, and improved audio recording quality. Another technical effect of one or more of the example embodiments disclosed herein is providing audio capture beamforming wherein the algorithm takes into account camera parameters such as zoom and focus information.

While various exemplary embodiments of the invention have been described in connection with beam forming, one skilled in the art will appreciate that various signal characteristics (or recording conditions) can be included with beamforming, wherein beamforming generally relates to a system that is increasing the level of audio signal received from some direction(s) compared to signals received from other direction(s) in a controlled manner. For example, this can be accomplished by summing the signals captured with different microphones with alternated amplitudes or delays. The processing can happen on-line (realtime) or off-line. For each microphone channel, it can be anything from a simple gain setting to multiple gain and delay filters for several frequency bands, varying in time. Additionally, beamforming can be applied to signals captured by narrowly spaced microphones. Both fixed and adaptive beamforming techniques are applicable.

It should be noted that although various exemplary embodiments of the invention have been described with reference to an audio channel, a camera module, a microphone module, and a microphone array, any suitable hardware and software integration for camera focus/zoom and software support between the audio channel and the camera module may be provided.

It should be understood that components of the invention can be operationally coupled or connected and that any number or combination of intervening elements can exist (including no intervening elements). The connections can be direct or indirect and additionally there can merely be a functional relationship between components.

As used in this application, the term 'circuitry' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Embodiments of the present invention may be implemented in software, hardware, application logic or a combination of software, hardware and application logic. The software, application logic and/or hardware may reside on the electronic device (such as one of the memory locations of the device, for example). If desired, part of the software, application logic and/or hardware may reside on any other suitable location, or for example, any other suitable equipment/location. In an example embodiment, the application logic, software or an instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer, with one example of a computer described and depicted in FIG. 3. A computer-readable medium may comprise a computer-readable storage medium that may be any media or means that can contain or store the instructions for use by or in connection with an instruction execution system, apparatus, or device, such as a computer.

Below are provided further descriptions of various non-limiting, exemplary embodiments. The below-described exemplary embodiments may be practiced in conjunction with one or more other aspects or exemplary embodiments. That is, the exemplary embodiments of the invention, such as those described immediately below, may be implemented, practiced or utilized in any combination (for example, any combination that is suitable, practicable and/or feasible) and are not limited only to those combinations described herein and/or included in the appended claims.

In one exemplary embodiment, an apparatus, comprising: a camera system, an optimization system, wherein the optimization system is configured to communicate with the camera system; and at least one microphone connected to the optimization system; wherein the optimization system is configured to adjust a beamform of the at least one microphone based, at least in part, on camera focus information of the camera system.

An apparatus as above wherein the camera focus information comprises a focus location relative to the camera system.

An apparatus as above wherein the optimization system is configured to estimate a distance between a sound source and the camera system.

An apparatus as above wherein the optimization system is configured to automatically adjust the beamform.

An apparatus as above wherein the focus information comprises a focus spot position on an image plane.

An apparatus as above wherein the optimization system comprises user selectable ranges for beam width adjustment of the beamform.

An apparatus as above wherein the optimization system is configured to produce an audio frame with a set directivity pattern.

An apparatus as above wherein the optimization system is configured to direct the beamform in a direction away from a center of an image capture area of the camera system.

An apparatus as above wherein the at least one microphone comprises at least one directional microphone, at least two omni-directional microphones, or an array of microphones.

An apparatus as above wherein apparatus comprises a two camera system configured to capture a stereo image.

An apparatus as above wherein the camera system comprises at least one camera.

An apparatus as above wherein the apparatus comprises a mobile phone.

In another exemplary embodiment, a method, comprising: receiving focus location information, wherein the focus location information corresponds to a focus location of a camera; receiving zoom setting information, wherein the zoom setting information corresponds to a zoom setting information of the camera; and controlling at least one microphone based, at least partially, on the focus location information and the zoom setting information.

A method as above wherein the focus location information comprises a focus location relative to the camera.

A method as above further comprising estimating a distance between a sound source and the camera.

A method as above wherein the controlling the at least one microphone further comprises automatically controlling the at least one microphone based, at least partially, on the focus location information and the zoom setting information, wherein the zoom setting information comprises a user selectable audio capture profile.

A method as above wherein the focus location information comprises a focus spot position on an image plane.

In another exemplary embodiment, a computer program product comprising a non-transitory computer-readable medium bearing computer program code embodied therein for use with a computer, the computer program code comprising: code for processing focus location information, wherein the focus location information corresponds to a focus location of a camera; code for processing zoom setting information, wherein the zoom setting information corresponds to a zoom setting information of the camera; and code for controlling at least one microphone based, at least partially, on the focus location information and the zoom setting information.

A computer program product as above further comprising code for estimating a distance between a sound source and the camera.

A computer program product as above wherein the code for controlling further comprises code for automatically controlling the at least one microphone based, at least partially, on the focus location information and the zoom setting information.

A computer program product as above wherein the focus location information comprises a focus spot position on an image plane.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

What is claimed is:

1. An apparatus, comprising:

a camera system;

an optimization system, wherein the optimization system is configured to communicate with the camera system; and at least one microphone connected to the optimization system;

wherein the optimization system is configured to automatically adjust a beamform of the at least one microphone based, at least in part, on focus location information of the camera system and zoom setting information of the camera system, wherein the zoom setting information is associated with an audio capture profile.

2. An apparatus as in claim 1 wherein the focus location information comprises a focus location relative to the camera system.

3. An apparatus as in claim 1 wherein the optimization system is configured to estimate a distance between a sound source and the camera system.

4. An apparatus as in claim 1 wherein the focus information comprises a focus spot position on an image plane.

5. An apparatus as in claim 1 wherein the optimization system comprises user selectable ranges for beam width adjustment of the beamform.

6. An apparatus as in claim 1 wherein the optimization system is configured to produce an audio frame with a set directivity pattern.

7. An apparatus as in claim 1 wherein the optimization system is configured to direct the beamform in a direction away from a center of an image capture area of the camera system.

8. An apparatus as in claim 1 wherein the at least one microphone comprises at least one directional microphone, at least two omni-directional microphones, or an array of microphones.

9. An apparatus as in claim 1 wherein apparatus comprises a two camera system configured to capture a stereo image.

10. An apparatus as in claim 1 wherein the camera system comprises at least one camera.

11. An apparatus as in claim 1 wherein the apparatus comprises a mobile phone.

12. A method, comprising:

receiving focus location information, wherein the focus location information corresponds to a focus location of a camera;

receiving zoom setting information, wherein the zoom setting information corresponds to a zoom setting information of the camera; and controlling at least one microphone based, at least partially, on the focus location information and the zoom setting information;

wherein the controlling the at least one microphone further comprises automatically controlling the at least one microphone based, at least partially, on the focus location information and the zoom setting information, wherein the zoom setting information is associated with an audio capture profile.

13. A method as in claim 12 wherein the focus location information comprises a focus location relative to the camera.

14. A method as in claim 12 further comprising estimating a distance between a sound source and the camera.

15. A method as in claim 12 wherein the zoom setting information comprises a user selectable audio capture profile.

16. A method as in claim 12 wherein the focus location information comprises a focus spot position on an image plane.

17. A computer program product comprising a non-transitory computer-readable medium bearing computer program code embodied therein for use with a computer, the computer program code comprising:

code for processing focus location information, wherein the focus location information corresponds to a focus location of a camera;

code for processing zoom setting information, wherein the zoom setting information corresponds to a zoom setting information of the camera; and code for automatically controlling at least one microphone based, at least partially, on the focus location information and the zoom setting information, wherein the zoom setting information is associated with an audio capture profile.

18. A computer program product as in claim 17 further comprising code for estimating a distance between a sound source and the camera.

19. A computer program product as in claim 17 wherein the focus location information comprises a focus spot position on an image plane.

* * * * *